United States Patent [19]

Webb et al.

[11] Patent Number: 4,934,756

[45] Date of Patent: Jun. 19, 1990

[54] CARDBOARD FURNITURE

[76] Inventors: Carolyn R. Webb, 3126 E. 27th St., Tulsa, Okla. 74114; Randy M. Westbrook, 1932 S. Cheyenne, Apt. A, Tulsa, Okla. 74119

[21] Appl. No.: 279,359

[22] Filed: Dec. 5, 1988

[51] Int. Cl.[5] ..... A47C 7/00

[52] U.S. Cl. ..... 297/442; 297/440

[58] Field of Search ..... 297/440, 442, 444, 458, 297/459, 460; 248/165, 174; 211/135, 195

[56] References Cited

U.S. PATENT DOCUMENTS

| | | | |
|---|---|---|---|
| 2,707,514 | 5/1955 | Smith | 297/442 |
| 2,806,514 | 9/1957 | Smith | 297/442 |
| 2,904,105 | 9/1959 | Holden | 297/442 |
| 2,940,513 | 6/1960 | Holden | 297/442 |
| 2,955,647 | 10/1960 | Smith | 297/442 |
| 3,331,634 | 7/1967 | Harrison, Jr. | 297/442 |
| 3,695,703 | 10/1922 | Notko | 297/442 |
| 4,340,251 | 7/1982 | Geoffroy-Dechawne | 297/442 |

*Primary Examiner*—Peter R. Brown
*Assistant Examiner*—Brian K. Green

[57] ABSTRACT

Improved cardboard furniture (e.g., chair, sofa, ottoman or the like) comprising a structural core of periodically slotted cardboard sheets interlocked in a criss-crossing, egg crate divider type assembly with external stabilizing cardboard surfaces made from cardboard sheets having their perimeter periodically slotted such as to form tabs that fold, insert and engage in the openings of the egg crate divider type assembly. Such cardboard furniture can be provided in a kit form that is readily hand assembled, without special tools, adhesives or other fasteners into structurally stable and anatomically correct light weight furniture.

1 Claim, 4 Drawing Sheets

CARDBOARD FURNITURE

BACKGROUND OF THE INVENTION

1. Field of the Invention:

This invention relates to improved cardboard furniture. More specifically, the invention relates to the use of snap-in-place cardboard surface members in combination with a honeycomb like cardboard egg crate divider core to make structurally sound and anatomically correct furniture.

2. Description of the Prior Art:

The basic concept of manufacturing and selling light weight furniture is generally known, particularly in regards to contemporary aluminum lawn chairs and the like. Likewise, the concept of providing either a pattern or kit for the do-it-yourselfer to make light weight furniture is generally known, for example, in making PVC pipe furniture. And, at least one academic institution has studied the possibility of designing light weight furniture from cardboard including the use of the so-called "egg crate divider" structural system involving a cardboard honeycomb made from a criss-cross pattern of interlocking, cut sheets or strips of cardboard. However, in the case of using cardboard as the structural material, very little commercial success or consumer acceptance has been achieved primarily because of the lack of dimensional rigidity and/or structural stability. Also, most light weight furniture has failed to achieve an acceptable level of comfort associated with an anatomically contoured seat, chair, or the like.

SUMMARY OF THE INVENTION

The present invention provides an inexpensive, light weight, structurally sound system for manufacturing anatomically correct furniture out of nothing but cardboard. According to the present invention, the cardboard furniture can be made out of pre-cut sheets of cardboard and assembled without the use of special tools, fasteners, adhesives or the like. As such, the piece of furniture can be sold as a kit and assembled by merely compressively snapping or folding the individual pieces together. Because of the use of external cardboard surface panels in combination with an internal "egg crate divider" core, the resulting furniture is rigid and dimensionally stable.

Thus, the present invention provides a cardboard furniture kit comprising in combination:

(a) a plurality of sheets of cardboard forming a first sequential set wherein each sheet of cardboard of the first sequential set is pre-cut such that the lower edge of each sheet is adapted to rest flat on a floor and at least one other edge is pre-cut to conform anatomically to the contour of the human body in a first direction parallel to a corresponding anatomically contoured portion of each other sheet of the first sequential set when sequentially positioned parallel and equal distance to each other and wherein the relative position of each anatomically contoured portion of each sheet of the first sequential set when sequentially positioned parallel and equal distance to each other correspond to the contour of the human body in a second direction perpendicular to the first direction and wherein each of the sheets of cardboard forming the first sequential set are periodically slotted such as to structurally engage to compatible periodical slots in a plurality of sheets of cardboard forming a second sequential set;

(b) a plurality of sheets of cardboard forming a second sequential set wherein each sheet of cardboard of the second sequential set is pre-cut such that the lower edge of each sheet is adapted to rest flat on a floor and at least one other edge is pre-cut to conform anatomically to the contour of the human body in a second direction perpendicular to the first direction and parallel to a corresponding anatomically contoured portion of each other sheet of the second sequential set when sequentially positioned parallel and equal distance to each other and wherein the relative position of each anatomically contoured position of each sheet of the second sequential set when sequentially positioned parallel and equal distance to each other corresponds to the contour of the human body in the first direction and wherein each of the sheets of cardboard forming the second sequential set is periodically slotted such as to structurally engage to the compatible periodical slots in the plurality of sheets of cardboard forming the first sequential set, thus being adapted to form simultaneously a flat surface of intersecting lower edges and at least one anatomically contoured surface of intersecting anatomically contoured other edges; and (c) at least one cardboard sheet wherein the perimeter of the sheet is periodically slotted such as to be adapted to form tabs that fold, insert, and engage around the perimeter of the anatomically contoured surface of intersecting anatomically contoured other edges.

It is an object of the present invention to provide cardboard furniture that is anatomically correct and structurally sound. It is a further object of the present invention to provide cardboard furniture in a kit form that is extremely inexpensive in that nothing other than cardboard is employed and no special tools or other equipment is necessary to hand assemble the kit. Fulfillment of these objects and the presence and fulfillment of other objects will become apparent upon complete reading of the specification and claims taken in conjunction with the attached drawings.

DESCRIPTION OF THE PREFERRED EMBODIMENTS

Figure 1:
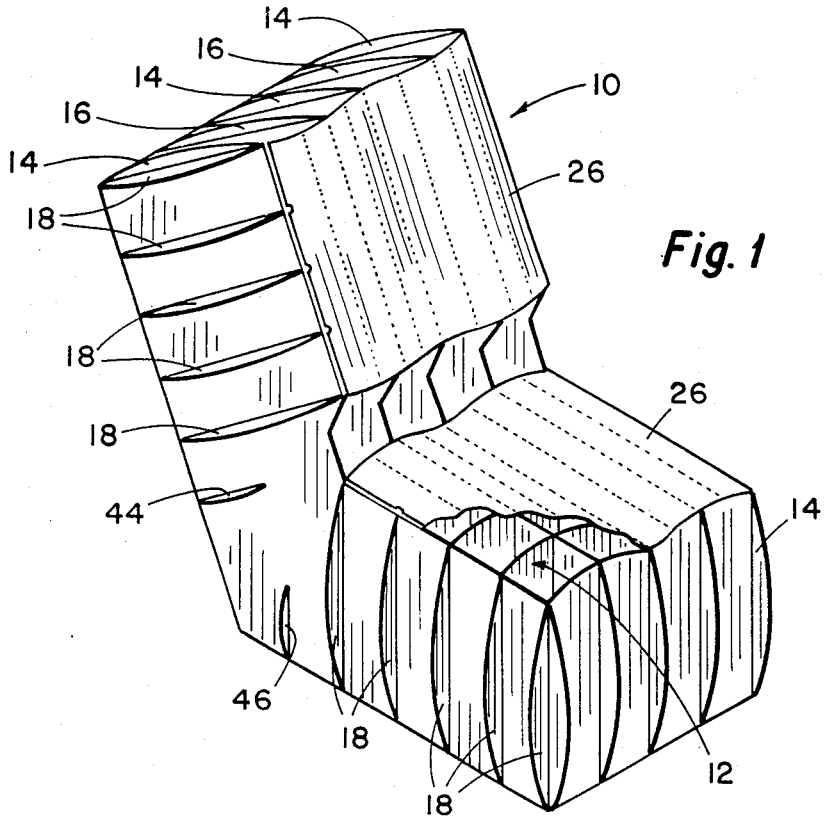
FIG. 1 a partial cut-away perspective view of a typical cardboard studio chair according to the present invention.

The improved cardboard furniture according to the present invention, how it can be provided and hand assembled in a kit form, and how it differs from previously known cardboard furniture can perhaps be best explained and understood by reference to the drawings. FIG. 1 illustrates a typical studio chair (generally designated by the numeral 10) according to the present invention. As illustrated in this specific embodiment, the studio chair 10 is made up entirely of pre-cut sheets of cardboard which are slotted periodically to either slide together forming a central structural core forming a so-called egg crate divider type criss-crossing pattern 12 or the sheets are periodically slotted to form tabs that bend, insert and engage to openings created by the egg crate divider structure.

Figure 2:
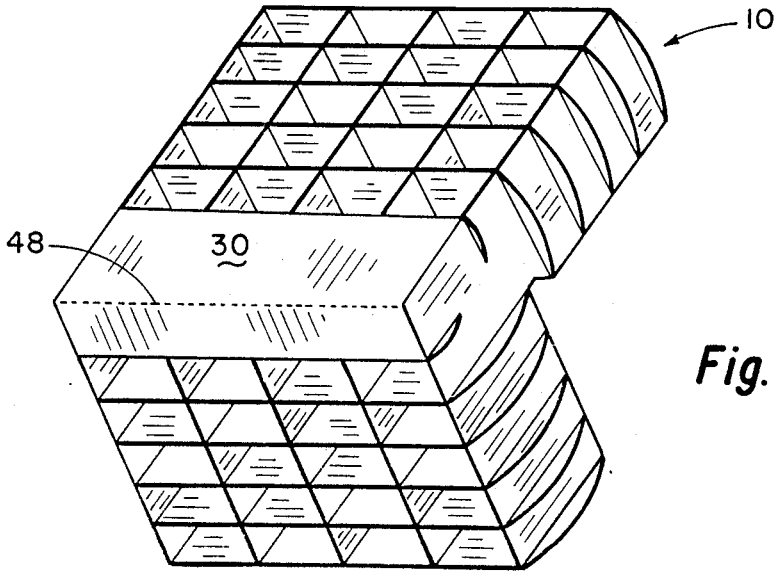
FIG. 2 is a bottom view of the cardboard studio chair of FIG. 1.
Figure 3:
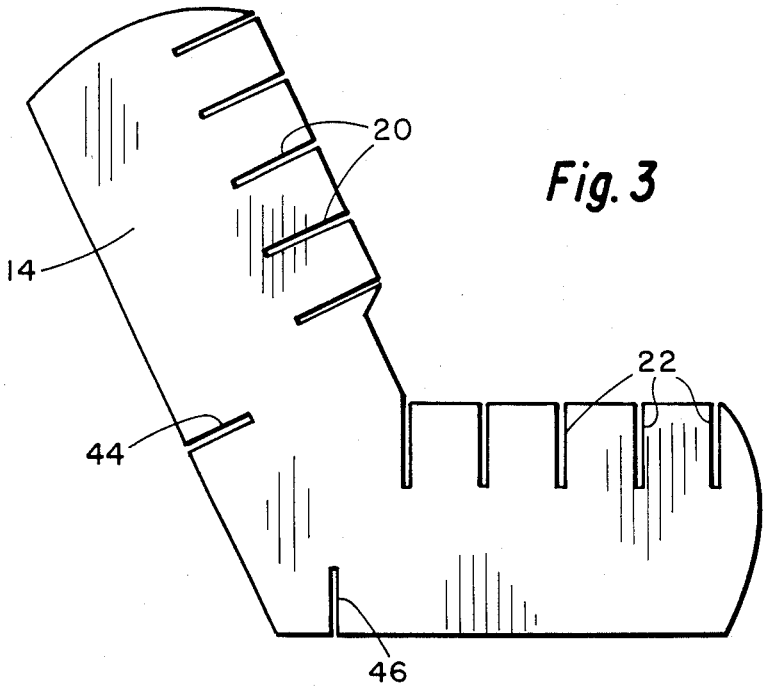
FIGS. 3 and 4 are side plan views of the vertical combined seat and back rest cardboard structural elements of the studio chair of FIG. 1.
Figure 4:
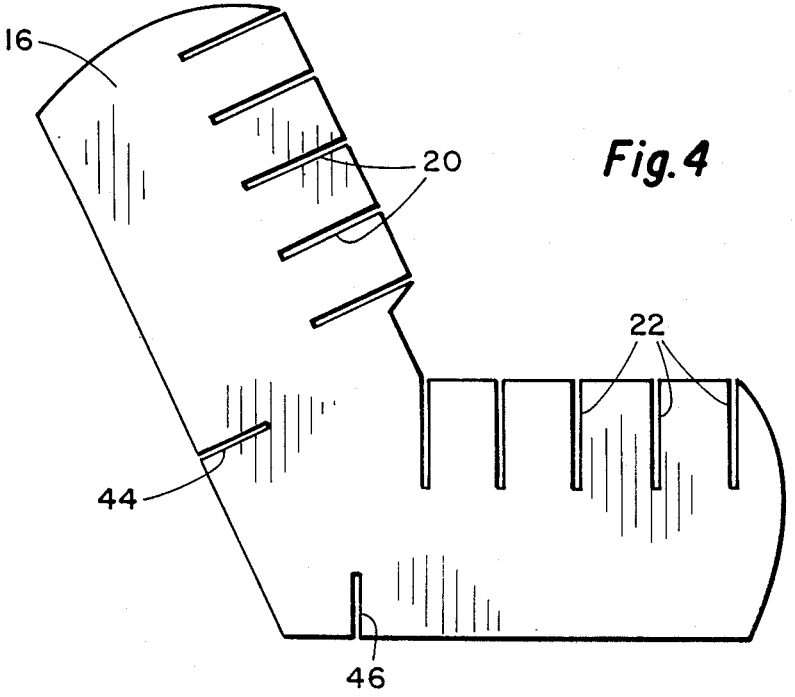
Figure 5:
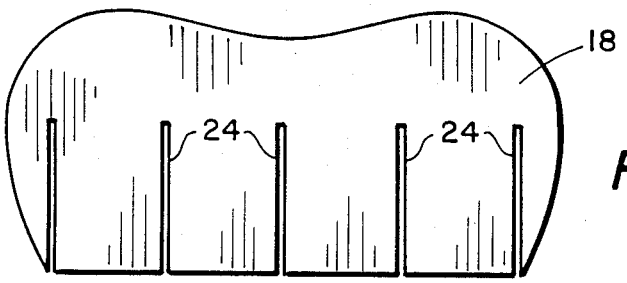
FIG. 5 is a side profile view of the cardboard structural elements of the studio chair of FIG. 1 that are part of the seat and the back rest but lie perpendicular to the structural elements of FIGS. 3 and 4.

As illustrated in FIGS. 1 and 2, the egg crate divider structure of the core of the studio chair 10 involves a sequential set of five vertical sheets of cardboard, three corresponding to sheet 14 of FIG. 3 and two corresponding to sheet 16 of FIG. 4. As seen in FIG. 1, sheets 14 are positioned at the outer sides and directly in the middle of the seat and back rest of chair 10, while the larger sheets 16 are positioned between sheets 14, thus producing a slight arch with a center depression in the seat and back rest. Perpendicular to sheets 14 and 16 are ten sheets 18 as shown in FIG. 5. Five of the sheets 18 criss-cross with the sheets 14 and 16 in the seat area of the chair 10 and the other five criss-cross with the sheets 14 and 16 in the back rest portion of the chair. As further seen in FIGS. 3, 4 and 5, the cardboard sheets 14, 16 and 18 are provided with interlocking slots 20, 22 and 24 periodically positioned along the back rest and seat edges of sheets 14 and 16 and along the flat bottom edge of sheet 18. The length and width of the slots are sufficient to allow the respective sheets to interlock with each other forming the egg crate divider type core structure of the chair 10.

Figure 6:
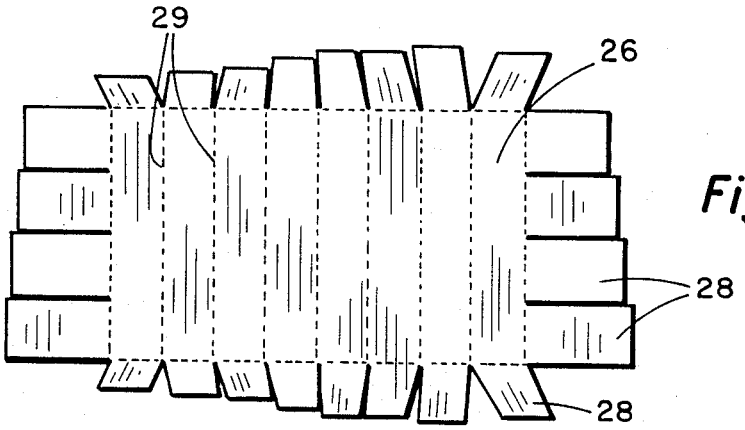
FIG. 6 is a top plan view of the surface panel for the seat and the back rest of the studio chair of FIG. 1 before assembly of the chair.
Figure 7:
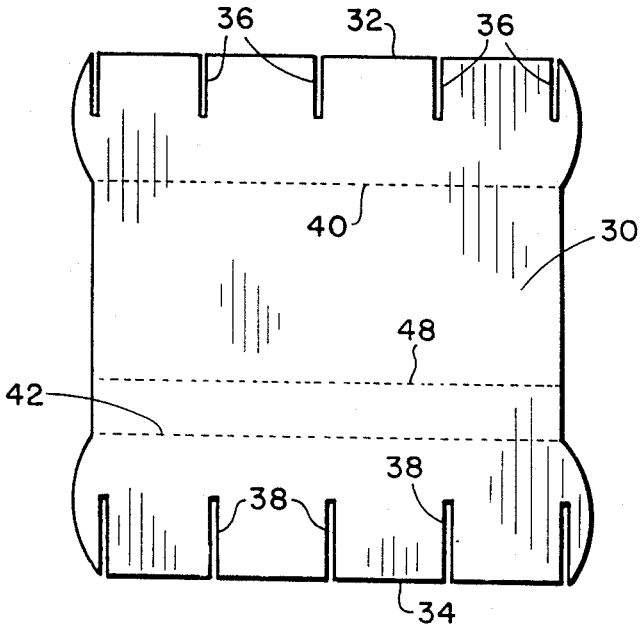
FIG. 7 is a top plan view of the base support element of the studio chair of FIG. 1 again before being folded and assembled to the chair.

As further seen in FIG. 1, both the seat area and the back rest area of the studio chair 10 are covered with a cardboard surface 26. As shown in FIG. 6, the cardboard surface 26 in the unassembled form is made from a single flat sheet of cardboard with the perimeter of the sheet 26 periodically slotted and scored, thus forming a series of adjacent flaps 28 and folding lines 29. The flaps 28 are intended to be bent during assembly of the chair 10 such that they insert and wedge into the opening formed between successive criss-crossed sheets 14, 16 and 18; i.e., between the square opening in the egg crate divider structure. In this manner, the cardboard surfaces 26 bends at the score lines 29 such as to conform to the geometry and curvature in the seat and back rest areas of the chair. In a similar manner, the under side and back side of the chair 10 are provided with an additional stabilizing cardboard sheet or surface 30, see FIG. 2. As shown in FIG. 7, the stabilizing sheet 30 involves an upper edge 32 and a lower edge 34, each having a series of periodical slots 36 and 38 that when folded about dashed lines 40 and 42 will insert into slots 44 and 46 of the cardboard sheets 14 and 16 (see FIGS. 3 and 4) making up the combined back rest and seat of chair 10. In order to engage slots 36 and 38 with slots 44 and 46, the entire sheet 30 is further folded about the central line 48, see FIGS. 2 and 7. Because of the presence of the exterior cardboard surfaces 26 and particularly the stabilizing cardboard surface 30, the entire chair 10 after assembly is extremely rigid, yet virtually no tools or adhesives need be employed during assembly. Because of the use of cardboard, the chair is extremely light weight and the respective edges of the structural elements can be readily contoured to anatomically conform to the contours of the human body.

Figure 8:
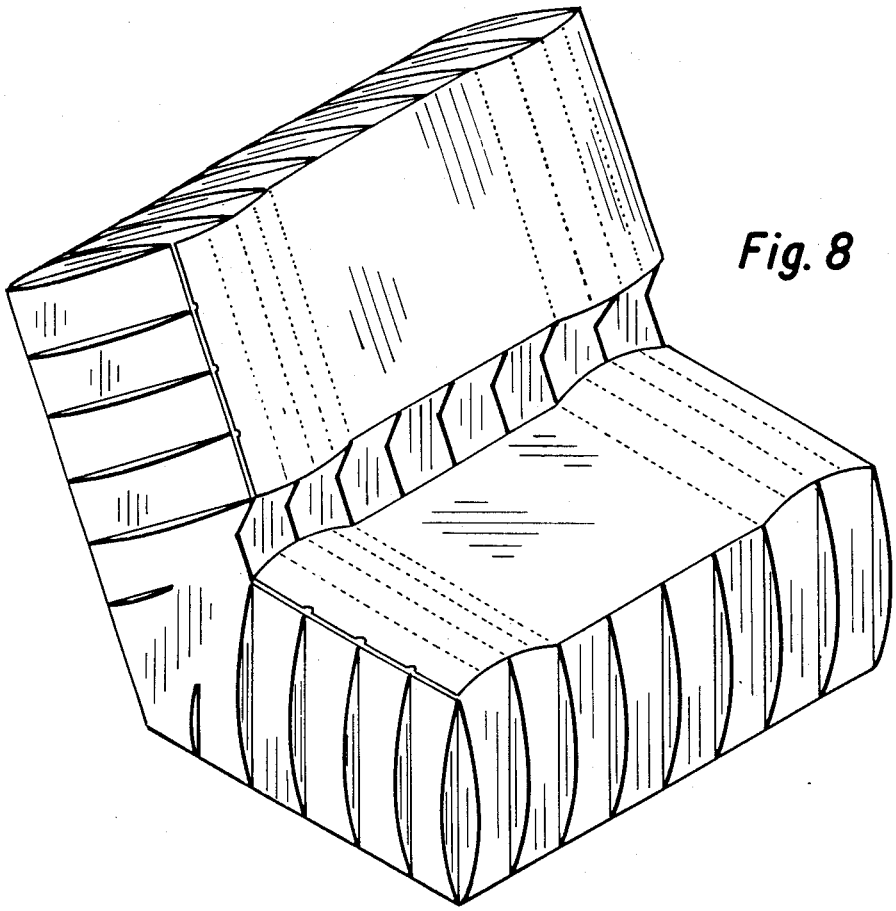
FIG. 8 is a perspective view of a studio sofa according to the present invention.
Figure 9:
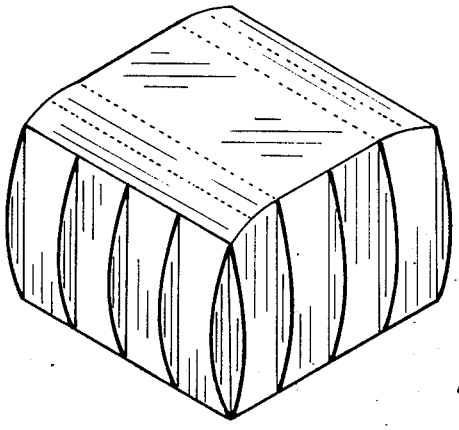
FIG. 9 is a perspective view of an ottoman according to the present invention.

As illustrated in FIGS. 8 and 9, the basic concept of the present invention can be readily incorporated into other pieces of furniture; including by way of example, but not limited thereto, a studio sofa as shown in FIG. 8, an ottoman as shown in FIG. 9 or the like. As suggested in FIG. 8 by extending the structural pieces corresponding to FIGS. 5, 6 and 7 to a greater length and by simultaneously providing a greater number of pieces of FIG. 3, a studio sofa can be readily produced. Similarly, by eliminating the back rest portion, an ottoman can be produced. It should be appreciated that other pieces of furniture could also be readily produced using the combination of surface stabilizing cardboard sheet and criss-crossing structural cardboard sheet honeycomb like core. It should also be appreciated that various other anatomically correct designs can be readily incorporated into the present invention, including a complete line of corresponding children's furniture.

More explicitly, in the case of the above illustrated studio chair, a back rest of approximately 32⅞ inches, and seat of 25 inches as measured along the bottom and back of the piece shown in FIGS. 3 and 4 with a seat height of approximately 12 11/16 inches, FIG. 3, (13 13/16 inches for FIG. 4) and a spacing of about 4 inches between slots will produce an anatomically correct studio chair for an average size adult. The corresponding measurements for a child's studio chair would be approximately 19.73 inches, 15 inches, 7.61 inches (8.29 inch for FIG. 4) and 2.40 inches, respectively. Typically, the width of the adult studio chair would be 28 inches while the child version would be 16.8 inches.

In order to facilitate the ease of assembly of the cardboard furniture according to the present invention and to insure structure integrity of the assembled piece of furniture, the respective slots in the individual cardboard sheet can preferably be slightly tapered such as to insure ease of initial alignment of a slot with another engaging slot and upon deep penetration create a firm wedge affect. Also, the length of the tabs positioned around the perimeter or along the outer edges of the surface forming cardboard sheets can preferably be staggered, as suggested in FIG. 6. This allows the slightly longer tab to be inserted first and systematically advanced deeper as the adjacent relatively shorter tab is folded and inserted into the next opening in the egg crate divided type structure. Furthermore, the surface forming sheets of cardboard can preferably be prescored, perforated or prefolded to facilitate conforming with the surface curvature of the underlying criss-crossed support members.

The actual manufacturing of the elements making up the cardboard furniture according to the present invention can be out of any of the common cardboard structural materials and by any of the well known fabrication techniques as generally known in the art. Preferably, the individual pieces are die cut to shape. Most preferably, the pieces are fabricated out of conventional cardboard box type material.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

We claim:

1. A cardboard furniture kit comprising in combination:

(a) a plurality of substantially L-shaped sheets of cardboard each having a horizontal portion and a vertical portion thus forming a first sequential set wherein each sheet of cardboard of said first sequential set is pre-cut such that a lower edge of the horizontal portion of each L-shaped sheet is adapted to rest flat on a floor and a top edge of the horizontal portion of each L-shaped sheet is pre-cut to conform anatomically to the contour of the seat and legs of a human body in that when pre-cut sheets of cardboard of said first sequential set are positioned vertically parallel and equal distance to each other the relative height of said top edges form an anatomically contoured seat surface comprising a maximum height for sheets on each side of a relative minimum height for sheets located in the center of said first sequential set and wherein each sheet of cardboard of said first sequential set is further pre-cut such that an edge of the vertical portion facing the horizontal portion of each L-shaped sheet conforms anatomically to the contour of the back of a human body in that when pre-cut sheets of cardboard of said first sequential set are positioned vertically parallel and equal distance to each other the relative position of said edges of the vertical portion facing the horizontal portion form an anatomically contoured backrest surface comprising a maximum height for sheets on each side of a relative minimum height for sheets in the center of said first sequential set, and wherein each of said sheets of cardboard forming said first sequential set are periodically slotted such as to structurally engage to compatible periodic slots in plurality of sheets of cardboard forming a second and third sequential set;

(b) a plurality of sheets of cardboard forming a second sequential set wherein each sheet of cardboard of said second sequential set is pre-cut such that a lower edge of each sheet is adapted to rest flat on a floor and a top edge is pre-cut to conform anatomically to the contoured seat surface of said first sequential set and wherein each of said sheets of cardboard forming said second sequential set is periodically slotted such as to structurally engage to periodical slots in said plurality of sheets of cardboard forming said first sequential set, thus being adapted to form simultaneously a flat surface of intersecting lower edges and an anatomically contoured seat surface of intersecting anatomically contoured top edges;

(c) a plurality of sheets of cardboard forming a third sequential set wherein each sheet of cardboard of said third sequential set is pre-cut such that an edge of each sheet conforms anatomically to the contoured backrest surface of said first sequential set and wherein each of said sheets of cardboard forming said third sequential set is periodically slotted such as to structurally engage to periodical slots in said plurality of sheets of cardboard forming said first sequential set, thus being adapted to form an anatomically contoured backrest surface of intersecting anatomically contoured edges;

(d) a first substantially rectangular cardboard sheet wherein the perimeter of said sheet is periodically slotted such as to be adapted to form tabs and wherein said cardboard sheet is creased along a plurality of substantially parallel folds traversing from one side of said cardboard sheet to the opposite side and wherein said tabs fold substantially perpendicular to said cardboard sheet to insert and engage around the entire perimeter of said anatomically contoured seat surface and wherein said cardboard sheet bends at said plurality of parallel creased folds such as to conform to said anatomically contoured seat surface and (e) a second substantially rectangular cardboard sheet wherein the perimeter of said sheet is periodically slotted such as to be adapted to form tabs and wherein said cardboard sheet is creased along a plurality of substantially parallel folds traversing from one side of said cardboard sheet to the opposite side and wherein said tabs fold substantially perpendicular to said cardboard sheet to insert and engage around the entire perimeter of said anatomically contoured backrest surface and wherein said cardboard sheet bends at said plurality of parallel creased folds such as to conform to said anatomically contoured backrest surface.

* * * * *